US008007660B2

(12) United States Patent
Miller et al.

(10) Patent No.: US 8,007,660 B2
(45) Date of Patent: Aug. 30, 2011

(54) REDUCED PUFFING NEEDLE COKE FROM DECANT OIL

(75) Inventors: Douglas J. Miller, North Olmsted, OH (US); Ching-Feng Chang, Strongsville, OH (US); Irwin C. Lewis, Oberlin, OH (US); Aaron Tomasek, Wooster, OH (US); Richard L. Shao, North Royalton, OH (US)

(73) Assignee: GrafTech International Holdings Inc., Parma, OH (US)

( * ) Notice: Subject to any disclaimer, the term of this patent is extended or adjusted under 35 U.S.C. 154(b) by 501 days.

(21) Appl. No.: 12/132,222

(22) Filed: Jun. 3, 2008

(65) Prior Publication Data

US 2009/0294327 A1 Dec. 3, 2009

(51) Int. Cl.
*C10C 1/00* (2006.01)

(52) U.S. Cl. ..... 208/50; 208/44; 208/46; 208/49; 208/39; 502/20; 502/34; 502/55; 502/56; 502/400; 502/405; 502/406

(58) Field of Classification Search ..... 208/44, 208/46, 49, 50, 39, 131; 423/444, 445; 502/20, 502/34, 55, 56, 400, 416, 405, 406
See application file for complete search history.

(56) References Cited

U.S. PATENT DOCUMENTS

| | | | | |
|---|---|---|---|---|
| 2,814,076 | A | 11/1957 | Gartland | |
| 3,363,401 | A * | 1/1968 | Solinhac et al. | 423/244.11 |
| 3,609,099 | A * | 9/1971 | Mickelson | 502/314 |
| 4,026,795 | A * | 5/1977 | Okamoto et al. | 502/33 |
| 4,312,745 | A | 1/1982 | Hsu et al. | |
| 4,405,439 | A * | 9/1983 | Simone | 208/45 |
| 4,814,063 | A | 3/1989 | Murakami et al. | |
| 5,059,301 | A * | 10/1991 | Roussel et al. | 208/50 |
| 5,068,026 | A | 11/1991 | Jager et al. | |
| 5,104,518 | A | 4/1992 | Jager | |
| 5,118,287 | A | 6/1992 | Orac et al. | |
| 5,162,286 | A * | 11/1992 | MacDowall | 502/425 |
| 5,167,796 | A | 12/1992 | Didchenko et al. | |
| 5,286,371 | A | 2/1994 | Goval et al. | |
| 5,538,929 | A * | 7/1996 | Sudhakar et al. | 502/180 |
| 5,695,631 | A | 12/1997 | Eguchi et al. | |
| 6,391,185 | B1 | 5/2002 | Shvarev et al. | |
| 7,202,195 | B2 | 4/2007 | Cannon et al. | |
| 2006/0211906 | A1 | 9/2006 | Berezutskiy | |
| 2008/0093260 | A1 * | 4/2008 | Koseoglu | 208/96 |

FOREIGN PATENT DOCUMENTS

| | | |
|---|---|---|
| JP | 59122585 | 7/1984 |

OTHER PUBLICATIONS

Heintz, E.A., "The Characterization of Petroleum Coke", Carbon vol. 34 pp. 699-709 (1996).
Sano, Y. et al., "Two-Step Absorption Process for Deep Desulfurization of Diesel Oil", Fuel 84, pp. 903-910 (2005).
Wagner, G. et al., "Capacitance Bridge Measurements of Thermal Expansion", 1986 International Carbon Conference in Baden-Baden Germany.

* cited by examiner

*Primary Examiner* — Glenn A Caldarola
*Assistant Examiner* — Michelle L Stein
(74) *Attorney, Agent, or Firm* — Waddey & Patterson, P.C.; James R. Cartiglia

(57) ABSTRACT

A reduced puffing needle coke is formed from decant oil, which includes a lesser amount of nitrogen within the coke so that carbon articles produced from such coke experience minimal expansion upon heating to graphitization temperatures.

22 Claims, 1 Drawing Sheet

REDUCED PUFFING NEEDLE COKE FROM DECANT OIL

BACKGROUND OF THE INVENTION

Background Art

Carbon electrodes, especially graphite electrodes, are used in the steel industry to melt both the metals and supplemental ingredients used to form steel in electrothermal furnaces. The heat needed to melt the substrate metal is generated by passing current through a plurality of electrodes and forming an arc between the electrodes and the metal. Currents in excess of 100,000 amperes are often used.

Electrodes are typically manufactured from needle coke, a grade of coke having an acicular, anisotropic microstructure. For creating graphite electrodes that can withstand the ultra-high power throughput, the needle coke must have a low electrical resisitivity and a low coefficient of thermal expansion (CTE) while also being able to produce a relatively high-strength article upon graphitization.

The specific properties of the needle coke may be dictated through controlling the properties of the coking process in which an appropriate carbon feedstock is converted into needle coke. Typically, the grade-level of needle coke is a function of the CTE over a determined temperature range. For example, premium needle coke is usually classified as having an average CTE of from about 0.00 to about $0.30\times10^{-6}$/C° over the temperature range of from about 30° C. to about 100° C. while regular grade coke has an average CTE of from about 0.50 to about $5.00\times10^{-6}$/C° over the temperature range of from about 30° C. to about 100° C.

To evaluate the CTE of a coke, it is first calcined to a temperature of about 1,000 to 1,400° C. It is then admixed with a molten pitch binder and the pitch/coke mixture is extruded to form a green electrode. The electrode is then baked to about 800-900° C. and then heated from 2,800-3,400° C. to effect graphitization. The CTE is measured on the graphitized electrode using either a dilatometer or the capacitance method (The capacitance method is described in a publication "Capacitance Bridge Measurements of Thermal Expansion" presented at the 1986 International Conference on Carbon at Baden-Baden Germany. The procedure for evaluating coke CTE is found in publication by E. A. Heintz, Carbon Volume 34, pp. 699-709 (1996), which are incorporated herein by reference in their entirety).

In addition to low CTE, a needle coke suitable for production of graphite electrodes must have a very low content of sulfur and nitrogen. Sulfur and nitrogen in the coke generally remain after calcination and are only completely removed during the high temperature graphitization process.

Needle coke derived from petroleum is produced using a decant oil feedstock. The decant oil is the residual fraction from catalytic treating of a petroleum (gas oil) distillate. It is usually common to utilize a treatment with hydrogen and a catalyst to treat the decant oil or precursor distillate to remove the sulfur and reduce the effective puffing of the coke. However, such treatments have only a very limited effect on the removal of nitrogen. High levels of nitrogen in the decant oil will result in coke puffing during graphitization.

If the needle coke contains too high a concentration of nitrogen and sulfur, the electrode will experience "puffing" upon graphitization. Puffing is the irreversible expansion of the electrode which creates cracks or voids within the electrode, diminishing the electrode's structural integrity as well as drastically altering both its strength and density.

The degree of puffing generally correlates to the percentage of nitrogen and sulfur present in the needle coke. Both the nitrogen and sulfur atoms are bonded to the carbon within the feedstock through covalent bonding typically in a ring arrangement. The nitrogen-carbon and sulfur-carbon bonding is considerably less stable than carbon-carbon bonding in high temperature environments and will rupture upon heating. This bond rupture results in the rapid evolution of nitrogen and sulfur containing gases during high temperature heating, resulting in the physical puffing of the needle coke. Another source of puffing may be the rupture of sulfur to sulfur bonds.

A variety of methods have been attempted to reduce the puffing of needle coke during the graphitization process, with most directed to the effects of sulfur. The approaches used involve either treating the needle coke feedstock with a catalyst and hydrogen to remove sulfur prior to coking or to introduce chemical additives to the coke which inhibit the puffing process.

One such approach has been the use of an inhibitor additive to either the initial feedstock or the coke mixture prior to the graphitization to an electrode body. U.S. Pat. No. 2,814,076 teaches of the addition of an alkali metal salt to inhibit the puffing. Such salts are added immediately prior to graphitizing an electrode. Notably, sodium carbonate is added by impregnating the article through a sodium carbonate solution.

U.S. Pat. No. 4,312,745 also describes the use of an additive to reduce the puffing of sulfur-containing coke. Iron compounds, such as iron oxide are added to the sulfur-containing feedstock with the coke being produced through the delayed-coking process. However, the use of such inhibitors can be detrimental to the coke, one such effect is an increase in the CTE of the coke.

Orac et al. (U.S. Pat. No. 5,118,287) discloses the addition of an alkali or alkaline earth metal to the coke at a temperature level above that where the additive reacts with the carbon but below the puffing threshold to thereby preclude puffing.

Jager (U.S. Pat. No. 5,104,518) describes the use of sulphonate, carboxylate or phenolate of an alkaline earth metal to a coal tar prior to the coking step to reduce nitrogen puffing in the 1400° C.-2000° C. temperature range. Jager et al. (U.S. Pat. No. 5,068,026) describes using the same additives to a coke/pitch mixture prior to baking and graphitization, again to reduce nitrogen-based puffing.

Other attempts have been made to preclude the puffing of electrodes through the use of carbon additives or various hydro-removal techniques. In U.S. Pat. No. 4,814,063, Murakami et al. describes the creation of an improved needle coke through the hydrogenation of the starting stock in the presence of a hydrogenation catalyst. Subsequently, the hydrogenated product undergoes thermal cracking with the product being cut into different fractions. In Japan Patent Publication 59-122585, Kaji et al. describes hydrorefining a pitch in the presence of a hydrogenating catalyst to remove nitrogen and sulfur, followed by coking of the pitch to give a reduced puffing needle coke.

Goval et al. (U.S. Pat. No. 5,286,371) teaches of passing a feedstock through a hydrotreating reaction zone to produce a hydrotreated residual product wherein the product can undergo a solvent extraction process.

Didchenko et al. (U.S. Pat. No. 5,167,796) teaches the use of a large pore size hydrotreating catalyst with hydrogen to remove sulfur from a petroleum decant oil prior to coking.

Unfortunately, needle coke produced by the prior art usually fails to address the problems of nitrogen remaining in the needle coke that is to be graphitized into an electrode. The additives used to reduce the puffing characteristics of needle coke counteract the sulfur components which would otherwise be liberated from the needle coke but fail to preclude puffing resulting from the nitrogen components.

What is desired, therefore, is a process for producing reduced puffing needle coke which does not require the use of puffing inhibitor additives. Indeed, a process which is superior in removing nitrogen from a feedstock for the production of needle coke which will be graphitized to an electrode article has been found to be necessary for producing high strength, reduced-puffing electrodes. Also desired is the inventive reduced-puffing needle coke with reduced nitrogen content for the production of graphite electrodes.

BRIEF DESCRIPTION

The present invention provides a process which is uniquely capable of reducing the nitrogen content of a decant oil feedstock for creating reduced-puffing needle coke. The inventive process provides a method where neither additives nor high temperature hydrogenation steps are necessary to remove the nitrogen from the decant oil feedstock in the process of making needle coke. Such reduced-puffing needle coke resists expansion during graphitization and provides electrode articles with improved density and strength characteristics, a combination of needle coke characteristics not heretofore seen. In addition, the inventive process for producing needle coke provides a reduced-puffing needle coke from decant oil without the excessive expenditures of both hydrogen and thermal energy.

More particularly, the inventive process reduces the nitrogen present in the decant oil feedstock by means of a nitrogen removal system. The nitrogen removal system comprises an adsorption separator where the nitrogen components can be removed from the decant oil feedstock. Such nitrogen removal systems allow for the entering decant oil feedstock stream to have a nitrogen content of from about 0.3% by weight to about 2% by weight and will produce a final calcined needle coke product having a nitrogen content of from about 0.03% to about 0.2% by weight. An important characteristic of this inventive process is the ability for the nitrogen removal process to function throughout a wide range of temperatures. Specifically the nitrogen removal system can function at ambient conditions as well as the standard temperatures required for the flow of a decant oil feed stock. For the removal of nitrogen, the decant oil feedstock can flow through a variety of system designs, including absorption beds and multiple columns arranged for the continuous treatment of the decant oil feedstock while one column is offline.

The inventive nitrogen removal system for producing reduced puffing needle coke carbon should use a nitrogen removal method which can operate without the addition of excessive thermal energy or hydrogen gas to facilitate nitrogen removal from the decant oil feedstock. The nitrogen removal system may include an activated carbon article as the primary nitrogen removal element of the nitrogen removal system. The activated carbon article acts to bind and physically remove the nitrogen containing components from the decant oil feedstock as the feedstock passes through the nitrogen removal system.

Alternatively, the nitrogen removal system may contain other suitable adsorbent materials including activated carbon fibers, activated alumina, silica gel, silica alumina and xeolites, which can optimally reduce the nitrogen content of the feedstock from about 0.03% to about 0.2% by weight.

In addition, it has been found highly advantageous to have a restoration system for the nitrogen removal system. The restoration system acts to regenerate the removal properties of the nitrogen removal system, through the disengagement of the nitrogen from the removal system. In nitrogen removal systems incorporating an activated carbon structure, the restoration system removes the nitrogen containing components from the internal pore system of the activated carbon. Alternatively, in nitrogen removal systems incorporating a alumina or silica-based adsorbents, the restoration system removes the nitrogen components from the active adsorption sites, freeing the active sites for future nitrogen adsorption.

The decant oil feedstock fed into the nitrogen removal column should be relatively free from ash as ash components may preclude needle coke formation with a low coefficient of thermal expansion.

After the decant oil feedstock exits the nitrogen removal column, the feedstock enters a hydrodesulfurization unit for the removal of excess sulfur existing in the decant oil. Hydrodesulfurization, as known to those skilled in the art, is a common method of utilizing a hydrogen feed stream and catalyst to remove sulfur components from a petroleum based product.

Subsequent to the hydrodesulfurization, the decant oil enters a delayed coking unit for the conversion of treated decant oil feedstock to needle coke. Delayed coking, as known in the art, is the thermal cracking process in which the liquid decant oil feedstock is converted into the solid needle coke. The delayed coking of the reduced puffing decant oil feedstock should be a batch-continuous, or semi continuous, process where multiple needle coke drums are utilized so that one drum is always being filled with feedstock.

An object of the invention, therefore, is a process for creating reduced puffing needle coke to be employed in applications such as production of graphite electrodes.

Another object of the invention is a process for creating reduced puffing needle coke having a nitrogen reducing system incorporating activated carbon as a nitrogen adsorbing agent.

Still another object of the invention a process for creating reduced puffing needle coke having a nitrogen reducing system incorporating an alumina or silica-containing adsorbent for the removal of nitrogen from the decant oil feedstock.

Yet another object of the invention is a reduced puffing coke which contains substantially less nitrogen and exhibits very little or no expansion upon graphitization.

These aspects and others that will become apparent to the artisan upon review of the following description can be accomplished by providing a decant oil feedstock having an average nitrogen content of from about 0.3% to about 2% by weight and treating the decant oil feedstock with the nitrogen removal system under relatively mild conditions at temperatures no greater than 140° C. The inventive process advantageously reduces the nitrogen content of the decant oil feedstock from about 0.03% to about 0.2% by weight allowing the feedstock to be converted into reduced-puffing needle coke.

The inventive process can utilize a nitrogen removal system with a variety of adsorbing agents, especially activated carbon, as well as activated alumina, silica gel, silica alumina and xeolites. Such additives are readily available from commercial sources such as Aldrich Chemical Co. and have been used for chromatographic separations and for separating heterocyclics from petroleum-derived diesel oil (Y. Sano et al., Fuel 84, 903 (2005)).

It is to be understood that both the foregoing general description and the following detailed description provide embodiments of the invention and, when read in light of the attached drawing, are intended to provide an overview or framework of understanding to nature and character of the invention as it is claimed.

DETAILED DESCRIPTION OF THE PREFERRED EMBODIMENTS

Figure 1:
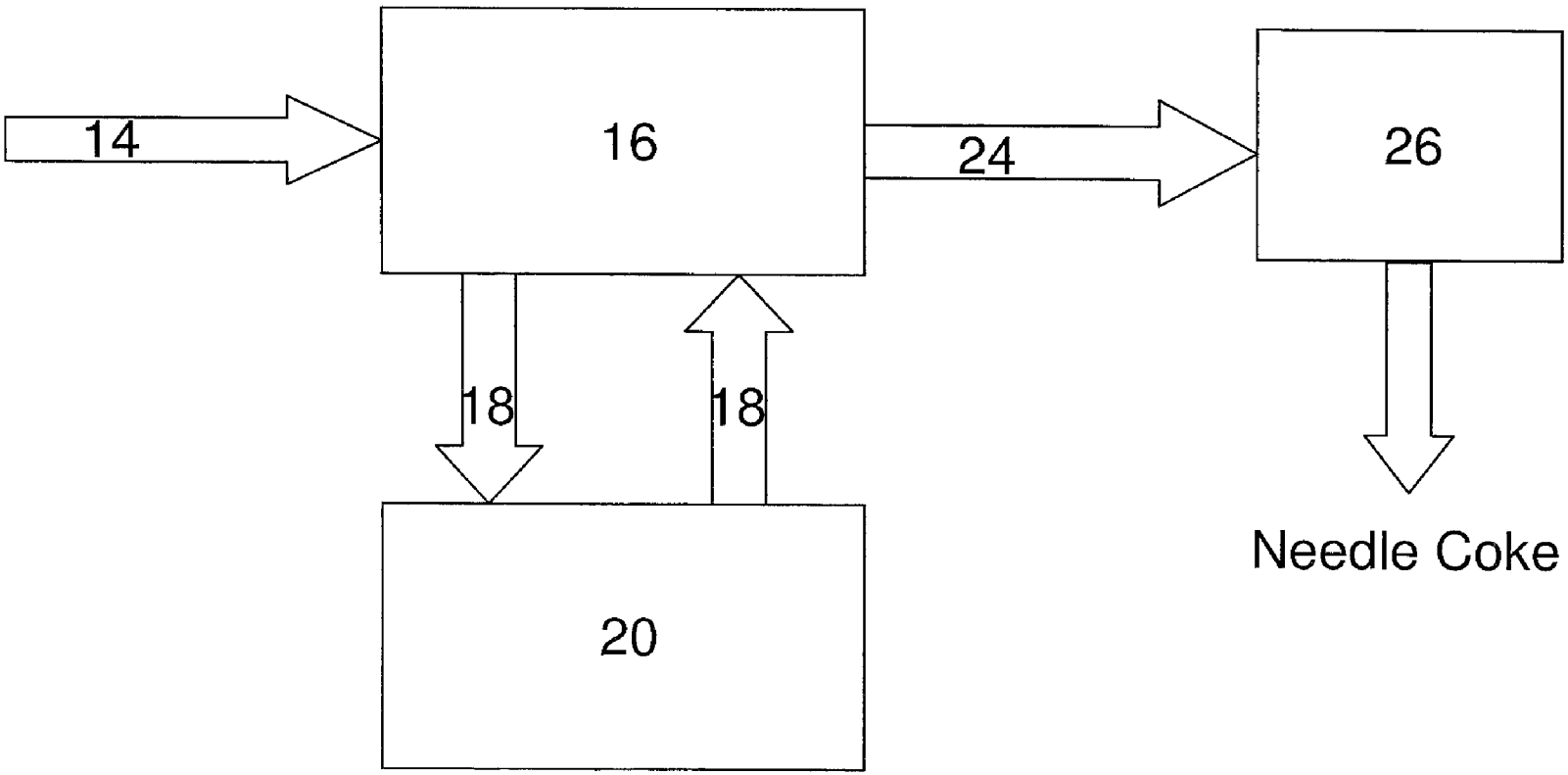
FIG. 1 is a schematic flow-diagram of the process to produce reduced puffing needle coke from a decant oil feedstock.

Reduced-puffing needle coke is prepared from fluid catalytic cracking decant oil, which contains up to about 0.4% by weight of ash. Ash is typically known as contaminant of a noncarbonaceous nature with a range of particle size. Typical ash components in decant oil are catalyst particles remaining from the cracking process used in producing the decant oil. In producing needle coke, the ash content should be reduced as excess ash results in an increase of the coefficient of thermal expansion of the final needle coke product.

Referring now to FIG. 1, ash-containing decant oil 10 flows into the ash-reduction system 12 for the removal of a significant portion of ash. As known to those skilled in the art, ash solids can be removed from decant oil through a variety of methods. These methods include a filtration system wherein the decant oil is passed through a membrane filter or a high-speed centrifugation system wherein centrifugal force is used to separate out the ash. An additional method involves the utilization of high voltage electric fields which polarize the ash particles allowing them to be captured from the decant oil. Initial decant oil 10 can have an ash content of from about 0.1% to 0.4% by weight prior to the treatment by theash-reduction system 12. Through treatment by the ash-reduction system 12 utilizing one or more of the above methods, ash-reduced decant oil 14 will have a ash percentage by weight of less than about 0.01%, more preferably below about 0.006%, most preferably below about 0.003%.

Upon treatment by the ash-reduction system 12, the ash-reduced decant oil 14 is directed toward the nitrogen removal system 16. As is necessary for the specific nitrogen removal system 16, the ash-reduced decant oil 14 can be heated or cooled to facilitate the best possible removal of nitrogen components during the processing within the nitrogen removal system 16. Specifically, slight heating can be utilized to decrease the viscosity of the decant oil and provide better contact between the oil and the reactive surfaces within the nitrogen removal system, however; such heating is not required for proper activity of the nitrogen removal system.

In one embodiment the nitrogen removal system 16 comprises a column loaded with nitrogen removing material. The column arrangement may include one or more columns in a parallel arrangement. Multiple columns are ideal so that when one goes off line, nitrogen removal system 16 can still be continuously operated.

In one alternative, the separation columns within the nitrogen removal system are of the fixed-bed (static) type. In these reactors the nitrogen-removing material is fixed and the column must be taken off line from decant oil processing to remove or regenerate the nitrogen-removing material. In another alternative, the columns within the nitrogen removal system are of the moving bed type. In moving bed type systems, the unit contains a fluidized bed of nitrogen removing material wherein the material is continuously removed and added to maintain desired activity of the nitrogen removal system.

One type of nitrogen removing material is activated carbon, carbon that has been treated to possess a ramified pore system throughout the carbon structure, resulting in a large internal specific surface area. Specifically, the activated carbon in the nitrogen removal system 16 can have a surface area in excess of 200 $m^2/g$, with upper limits up to and above about 3000 $m^2/g$. Such activated carbon for the nitrogen removal system 16, can be created from a variety of organic sources, including, but not limited to hardwoods, coal and coke products, cellulosic materials and polymer resins. Additionally, the activated carbon can be activated carbon fibers, rather than typical activated carbon in granular formation. Typically the activated carbon will have a trimodal pore distribution of micropores, mesopores, and macropores, with the pore size ranging from less than 2 nanometers for micropores to greater than 50 nm for macropores.

The primary means of removing nitrogen components from the ash-reduced decant oil within nitrogen removal system 16 is through adsorption by activated carbon. The two primary physical considerations of the activated carbon to consider in best selecting activated carbon for the adsorption of nitrogen components from a decant oil are the total surface area and pore structure. A large total surface of the activated carbon permits the availability of more active sites for the interaction with nitrogen components of ash-reduced decant oil 14. Furthermore, both the macropores and the mesopores of the activated carbon provide mechanical exclusion of particles from becoming adsorbed within the ramified pore system of the activated carbon, while allowing smaller molecules to the inner micropores. The pore size physically limits the particular size of the molecule which can reach the inner micropores of the activated carbon and thus be removed from ash-reduced decant oil 14. The nitrogen containing components, within ash-reduced decant oil 14, are sufficiently small in molecular size to reach the micropores of the activated carbon and become trapped and thereby removed from ash-reduced decant oil 14.

While any form of activated carbon is effective at nitrogen removal in accordance with the present invention, pH-neutral activated carbon has been found to be especially effective. In addition, in another embodiment of the use of activated carbon in nitrogen removal system 16, acid-washed (or partially neutralized) activated carbon or activated carbon with surface functional groups having high nitrogen affinity is employed, either in substitution for pH-neutral activated carbon, or in combination therewith. Reference herein to "activated carbon" refers to activated carbons generally or to any or all of pH-neutral activated carbon, acid-washed or partially neutralized activated carbon, activated carbon with surface functional groups, or combinations thereof The use of acid-washed or partially neutralized activated carbon may be more effective at the removal of nitrogen-containing heterocyclic compounds (typically Lewis bases) from decant oil. The acid-washed or partially neutralized activated carbon would have additional acidic functional groups as compared with pH-neutral activated carbon, which can make bonding interactions with nitrogen-containing species more likely. Activated carbons having surface functional groups with high nitrogen affinity, such as those impregnated with metals such as $NiCl_2$, can more effectively form metal-complexes with nitrogen species and so trap the nitrogen compounds within the carbon.

An additional component of nitrogen removal system 16 is the structural elements which maintain the activated carbon while ash-reduced decant oil 14 passes through the bed. Typical to adsorption with activated carbon, the activated carbon may require a substantial retention time with the ash-reduced decant oil 14 for the removal of nitrogen. Ash-reduced decant oil 14 may be in contact with the activated carbon on the order of hours to adequately remove nitrogen from the feedstock. To make possible the immobility of the activated carbon, a fixed bed type column is a preferred embodiment, as this style is commonly used for the adsorption from liquids. In an additional embodiment, the activated carbon can be housed in a moving bed column wherein the activated carbon is slowly withdrawn as it becomes spent.

For the optimal removal of nitrogen from ash-reduced decant oil 14 by the nitrogen removal system 16, processing parameters can be designed for best reaction conditions between the activated carbon and the decant oil. As adsorption usually increases with decreasing temperature, ash-reduced decant oil 14 can be fed into nitrogen removal system 16 at the lowest temperature consistent with adequate flow of the decant oil. Furthermore, the pH can optionally be altered to also facilitate better adsorption, typically allowing the nitrogen within the ash-reduced decant oil 14 to be in a more adsorbable condition.

Other process considerations include the time in which the decant oil is in contact with the activated carbon. Adsorption is also dependent upon the total time in which the nitrogen components are able to be in contact with the activated carbon. Therefore, increasing contact time between the activated carbon and the decant oil allows for a greater proportion of the nitrogen to be removed. Methods of increasing contact time include reducing the flow rate of the decant oil, increasing the amount of activated carbon within the bed, or providing activated carbon with a greater surface area.

Upon diminished performance of the adsorption of nitrogen from ash-reduced decant oil 14, the activated carbon component may be either discarded or reactivated for continued use. Depending on the costs of thermal energy and the current price of activated carbon, economics might dictate the disposal of the activated carbon and the deposit of fresh activated carbon within the beds of nitrogen removal system 16. If nitrogen removal system 16 includes one or more moving bed columns, the activated carbon can continuously be drawn off as the catalyst becomes spent. Otherwise, the system can be shut down and the activated carbon can be removed in a batch-wise fashion.

In a further alternative, the activated carbon of the nitrogen removal system 16 can undergo regeneration where the activated carbon is significantly freed of adsorbed nitrogen components. In one embodiment, the spent carbon is allowed to flow from nitrogen removal system 16 to the regeneration unit 20 via connection 18. Possible mechanisms for travel of the activated carbon from nitrogen removal system 16 to regeneration unit 20 include either a gravity-induced flow or a pressurized flow arrangement for transport of the spent activated carbon to regeneration unit 20. Upon regeneration, the activated carbon can flow backing the nitrogen removal system 16 via connection 22. Alternatively, the static bed containing the spent activated carbon can be completely taken off line and the spent activated carbon can be removed in a batch-wise fashion and inserted into the regeneration system 20.

In one embodiment of the regeneration system 20, the nitrogen removal system utilizes a thermal regeneration technique to reactivate the spent activated carbon. Specifically, the regeneration unit may include a furnace or rotary kiln arrangement for the thermal vaporization of adsorbents on the activated carbon. Typical temperatures for vaporizing the absorbed molecules can range from about 400° C. up to about 1000° C. In one embodiment, the absorbed molecules are vaporized at a temperature of no more than about 900° C. In another embodiment, the temperature may range from about 400° C. up to about 600° C. In a further embodiment, the temperature may range from about 700° C. to about 1000° C. Alternatively, the spent activated carbon can be stripped by steam for the removal of contaminants. In steam stripping regeneration the temperature of the steam can vary from about 100° C. up to about 900° C. for the removal of most adsorbents.

With the above regeneration techniques the activated carbon will eventually have to be replaced as the thermal regeneration techniques as well as the steam regeneration techniques, oxidize a portion of the activated carbon each time. For instance, approximately 10% by weight of the activated carbon can be lost during each thermal regeneration while about 5% by weight of the activated carbon is lost when utilizing steam regeneration techniques.

In an alternative embodiment of the nitrogen removal system 16, a variety of inorganic adsorbents can used in a column type arrangement to function as nitrogen removal system at temperatures much lower than prior art processes, preferably under temperature and other conditions which are lower than prior art processes, and more preferably at or about ambient conditions or lower. The adsorbent can be of a variety of high surface inorganic materials, including preferably activated alumina as amorphous alumina, silica alumina, titania, zirconia, silica gel, charged silica, zeolite, and a variety of high surface area active metal oxides including those of nickel, copper, iron and so on. These adsorbents with their high surface areas provide a large number of active sites for the removal of nitrogen components from the decant oil.

Specifically, gamma alumina can have a surface area of from about 1 $m^2/g$ to over 100 $m^2/g$, is quite rigid and can be formed in a variety of shapes for placement within the nitrogen removal system 16. These shapes include a variety of sized pellets, honeycomb, helical, and a variety of polygonal arrangements typical for fixed bed reactors.

Such type of adsorbent materials are used in analytical separations such as chromatography. Active alumina adsorbents have also been used for separation of heterocyclic compounds from diesel oil. (Y. Sano et al., Fuel 84, 903 (2005)).

Similar to activated carbon, inorganic adsorbents such as activated alumina can also be recycled as its disposal would be quite costly in the production of reduced-puffing needle coke. Larger contaminants can be removed through a steam stripping process wherein the adsorbent material is exposed to steam in a temperature range of from about 100° C. to about 500° C., however if desired, the temperature may be greater than 500° C., and a pressure of from about 10 psig to about 50 psig. Any contaminants not removed can be removed through a subsequent thermal treatment to regenerate the adsorption activity. The thermal treatment process includes temperatures in the range of from about 500° C. to about 900° C. Total processing time for regeneration is dependant upon the selected thermal treatment temperature allowing the user to optimize the regeneration specific to the overall needle coke production process. Over repeated regenerations, the adsorbent will lose activity and require its replacement or reconstruction.

Upon exiting the nitrogen removal system 16, treated decant oil 24 is directed to the to the hydrodesulfurization unit. Nitrogen-reduced decant oil 24 exits nitrogen removal system 16 and enters hydrodesulfurization unit 26 for the removal of sulfur from the nitrogen-reduced decant oil 24. As sulfur is a major cause of puffing among graphite electrodes produced from decant oil, the sulfur content must be significantly reduced prior to coking the decant oil. Hydrodesulfurization (HDS) is a process where the sulfur compounds are reacted with hydrogen gas in the presence of some catalyst, usually at elevated temperatures. HDS is a well known art in the art and used extensively in producing coke from high-sulfur containing feedstocks. Examples of desulfurization include U.S. Pat. Nos. 2,703,780, 3,891,538, 4,075,084, and 5,167,796. A practitioner of the art would be able to tailor the degree of hydrogenation for decant oil to reduce the amount of sulfur by weight to below 0.5%, preferably below 0.25%, most preferably below 0.1%.

After the reduction of sulfur of the decant oil by hydrodesulfurization unit 26, the desulfurized decant oil is directed to coking unit 28. A variety of methods exist for coking a decant oil feedstock, with delayed coking being the most common method for creating needle coke. A standard delayed coking unit preferably comprises two or more needle coke drums operated in a batch-continuous process. Typically, one portion of the drums is filled with decant oil while the other portion of the drums undergoes thermal processing.

Prior to a needle coke drum being filled, the drum is preheated by thermal gases recirculated from the coking occurring in the other set of needle coke drums. The heated drums are then filled with preheated decant oil feedstock wherein the liquid feedstock is injected into the bottom portion of the drum and begins to boil. With both the temperature and pressure of the coking drum increasing, the liquid feedstock becomes more and more viscous. The coking process occurs at temperatures of from about 400° C. to about 550° C., preferably 425-525, and more preferably 450-500, and pressures from about ambient up to about 100 psig. Slowly, the viscosity of the decant oil increases and begins to form needle coke.

The coke produced by the aforementioned process is then calcined at temperatures up to or about 1400° C. The calcined reduced puffing needle coke preferably has a CTE below about 2.0 cm/cm/° C.*$10^{-7}$, more preferably below about 1.25 cm/cm/° C.*$10^{-7}$, and most preferably below about 1.0 cm/cm/° C.*$10^{-7}$. Furthermore, the calcined reduced puffing needle coke has less than about 0.2% by weight, more typically about 0.1% by weight, and most preferably less than 0.03% by weight nitrogen content while having less than about 1.0% by weight sulfur content, and the needle coke exhibits very little nitrogen-induced physical expansion during graphitization to temperatures well above 2000° C.

Without intending to limit the scope of the invention, the following examples demonstrate the advantages of the practice of the present invention in removing nitrogen from a decant oil.

EXAMPLE 1

A 20 cubic centimeter (cc) sample of decant oil having a nitrogen content of 1857 parts per million (ppm) is diluted with toluene at a 1:1 ratio by volume, and blended with an absorbent. The absorbent is an activated carbon commercially available from Kansai Coke & Chemical Co. having a surface area of 2700 square meters per gram ($m^2/g$) and pore volume of 1.31 milliliters per gram (ml/g). Before the adsorption experiment, the adsorbent is pretreated under vacuum at 80° C. in order to remove water and other contaminants, which might inhibit the adsorption of nitrogen compounds. The decant oil/toluene blend is heated to 100° C. to have sufficient fluidity and is then blended with adsorbent at an oil/adsorbent weight ratio of 5:1, and maintained for 2 hours. After adsorption, the treated decant oil is separated from adsorbent and toluene is removed by evaporation under $N_2$ flow. The treated decant oil is found to have a nitrogen content of 1541 ppm, a decrease of 17%.

EXAMPLE 2

In order to remove further nitrogen compounds, two-stage adsorption experiments are performed at the same adsorption conditions. The decant oil produced in Example 1 is separated from the adsorbent, and then immediately mixed with fresh activated carbon for second stage adsorption. The second stage adsorption is also performed at 100° C. for 2 hours. The resulting decant oil is found to have a nitrogen content of 1168 ppm, a 37% decrease from the original sample.

EXAMPLE 3

A 20 cubic centimeter (cc) sample of decant oil having a nitrogen content of 1990 parts per million (ppm) is blended with one of two absorbents. One of the absorbents is an activated carbon commercially available as Nuchar SA-20 from Westvaco, having a surface area of 1843 square meters per gram ($m^2/g$) and an average pore size of 28.6 angstroms. The other absorbent is an acidic activated alumina commercially available from Aldrich Chemical Co., having a gamma crystalline phase with a surface area of 155 $m^2/g$ and an average pore size of 58 angstroms. Before the adsorption experiment, the adsorbents are pretreated under vacuum at 80° C. in order to remove water and other contaminants, which might inhibit the adsorption of nitrogen compounds. The decant oil is heated to 140° C. to have sufficient fluidity and is then blended with adsorbent at an oil/adsorbent weight ratio of 5:1, and maintained for 2 hours. After adsorption, the treated decant oil is separated from adsorbent. The decant oil treated with activated carbon is found to have a nitrogen content of 1617 ppm, a decrease of 18.8%; the decant oil treated with activated alumina is found to have a nitrogen content of 1707 ppm, a decrease of 14.2%.

Based on the results shown in Examples 1-3, the inventive adsorption process at mild operating conditions (low temperature and pressure) can significantly reduce the nitrogen concentration in decant oil, resulting in the production of improved needle coke feedstock.

The disclosures of all cited patents and publications referred to in this application are incorporated herein by reference.

The above description is intended to enable the person skilled in the art to practice the invention. It is not intended to detail all of the possible variations and modifications that will become apparent to the skilled worker upon reading the description. It is intended, however, that all such modifications and variations be included within the scope of the invention that is defined by the following claims. The claims are intended to cover the indicated elements and steps in any arrangement or sequence that is effective to meet the objectives intended for the invention, unless the context specifically indicates the contrary.

What is claimed is:

1. A method of creating reduced puffing needle coke, comprising:

a. passing decant oil through an activated carbon nitrogen removal system to remove nitrogen from the decant oil by adsorption and to produce reduced nitrogen decant oil;

b. hydrodesulfurizing the reduced nitrogen decant oil to create low-sulfur, reduced nitrogen decant oil;

c. coking the low-sulfur, reduced nitrogen decant oil d. calcining the coke obtained from step (c) to create reduced puffing needle coke.

2. The method of claim 1 wherein the decant oil of step a) has a nitrogen content of from about 0.3% by weight to about 2% by weight and a ash content of from about 0.1% by weight to about 0.4% by weight.

3. The method of claim 1 wherein the activated carbon nitrogen removal system of claim 1 includes activated carbon with a surface area of from about 200 $m^2/g$ to about 3000 $m^2/g$.

4. The method of claim 3 wherein the activated carbon is in the form of activated carbon fibers.

5. The method of claim 3 wherein the activated carbon is acid-washed or partially neutralized.

6. The method of claim 3 wherein the activated carbon has surface functional groups.

7. The method of claim 6 wherein the activated carbon is impregnated.

8. The method of claim 3 wherein the activated carbon nitrogen removal system comprises one or more columns.

9. The method of claim 8 wherein the column is a fixed-bed type.

10. The method of claim 8 wherein the column is a moving-bed type.

11. The method of claim 1 wherein the activated carbon nitrogen removal system of step a) further comprises a regeneration unit.

12. The method of claim 11 wherein the regeneration unit utilizes thermal regeneration at a temperature of from about 400° C. to about 1000° C.

13. The method of claim 11 wherein the regeneration unit utilizes steam regeneration at a temperature of at least about 100° C.

14. The method of claim 1 wherein the reduced needle puffing coke of step d) has a nitrogen content of up to about 0.2%.

15. A method of creating reduced puffing needle coke, comprising:

a. removing ash from decant oil to create ash-reduced decant oil;

b. passing the ash-reduced decant oil through an adsorption zone to produce reduced nitrogen decant oil;

c. coking the reduced nitrogen decant oil d. calcining the coke obtained from step (c) to create reduced puffing needle coke.

16. The method of claim 15 wherein the adsorption zone of step b) includes an inorganic adsorbent.

17. The method of claim 16 wherein the adsorbent is selected from the group consisting of activated alumina, amorphous alumina, silica alumina, titania, ziconia, zeolite, silica gel, charged silica, nickel oxide, copper oxide, iron oxide and combinations thereof.

18. The method of claim 16 wherein the adsorbent is activated alumina.

19. The method of claim 15 wherein the adsorption zone further comprises a regeneration unit.

20. The method of claim 19 wherein the regeneration unit includes steam stripping of the contaminants from an adsorbent included in the adsorption zone.

21. The method of claim 19 wherein the regeneration unit includes thermal stripping of the contaminants from an adsorbent included in the adsorption zone.

22. The method of claim 15 wherein the reduced puffing needle coke has a nitrogen content of up to about 0.2%.

* * * * *